US006325086B1

(12) United States Patent
Shinner et al.

(10) Patent No.: US 6,325,086 B1
(45) Date of Patent: Dec. 4, 2001

(54) COLLAPSIBLE FABRIC STRUCTURES WITH COILABLE SUPPORTS

(75) Inventors: Neil T. Shinner; Raymond Smith, both of London (GB)

(73) Assignee: Worlds Apart Limited, London (GB)

( * ) Notice: Subject to any disclaimer, the term of this patent is extended or adjusted under 35 U.S.C. 154(b) by 0 days.

(21) Appl. No.: 09/515,036

(22) Filed: Mar. 6, 2000

(30) Foreign Application Priority Data

| | | |
|---|---|---|
| Oct. 18, 1999 | (GB) | 9924622 |
| Dec. 7, 1999 | (GB) | 9928970 |
| Dec. 29, 1999 | (GB) | 9930776 |
| Feb. 23, 2000 | (GB) | 0004278 |

(51) Int. Cl.[7] ..... E04H 15/40

(52) U.S. Cl. ..... 135/126; 135/117; 135/130; 135/137

(58) Field of Search ..... 135/128, 125, 135/130, 137, 117, 126

(56) References Cited

U.S. PATENT DOCUMENTS

| | | |
|---|---|---|
| 3,675,667 | 7/1972 | Miller . |
| 3,960,161 | 6/1976 | Norman . |
| 3,990,463 | 11/1976 | Norman . |
| 4,815,784 | 3/1989 | Zheng . |
| 4,825,892 | 5/1989 | Norman . |
| 4,858,634 | 8/1989 | McLeese . |
| 5,038,812 | 8/1991 | Norman . |
| 5,059,463 | 10/1991 | Peters . |
| 5,137,044 | 8/1992 | Brady . |
| 5,163,461 | 11/1992 | Ivanovich et al. . |
| 5,249,592 | 10/1993 | Springer et al. . |
| 5,301,705 | 4/1994 | Zheng . |
| 5,337,772 | 8/1994 | Habchi . |
| 5,343,887 | 9/1994 | Danaher . |
| 5,370,145 | 12/1994 | Wu . |
| 5,427,381 | 6/1995 | Macaluso . |
| 5,439,017 | 8/1995 | Brown . |
| 5,467,794 | 11/1995 | Zheng . |
| 5,560,385 | 10/1996 | Zheng . |
| 5,579,799 | 12/1996 | Zheng . |
| 5,601,105 | 2/1997 | Blen et al. . |
| 5,645,096 | 7/1997 | Hazinski et al. . |
| 5,664,596 | 9/1997 | Zheng . |
| 5,676,168 | 10/1997 | Price . |
| 5,722,446 | 3/1998 | Zheng . |
| 5,778,915 | 7/1998 | Zheng . |
| 5,816,278 | 10/1998 | Kim . |
| 5,816,279 | 10/1998 | Zheng . |
| 5,816,954 | 10/1998 | Zheng . |

FOREIGN PATENT DOCUMENTS

| | | |
|---|---|---|
| 94 90 172 | 5/1995 | (DE) . |
| 0 942 142 A1 | 6/1999 | (EP) . |
| 0 928 864 A2 | 7/1999 | (EP) . |
| 0 928 865 A1 | 7/1999 | (EP) . |
| 2 263 920 A | 8/1993 | (GB) . |
| 2072126 | 7/1998 | (GB) . |
| 2076801 | 12/1998 | (GB) . |
| 3-21779 | 1/1991 | (JP) . |
| 6-42227 | 2/1994 | (JP) . |
| 8-57164 | 3/1996 | (JP) . |
| 98/51890 | 11/1998 | (WO) . |
| 99/25942 | 5/1999 | (WO) . |

*Primary Examiner*—Beth A. Stephan
(74) *Attorney, Agent, or Firm*—Pillsbury Winthrop LLP

(57) ABSTRACT

A collapsible fabric structure is described having two wall members, each having a coilable frame. When the structure is expanded, each frame forms a loop defining a pair of opposed sides. To collapse the wall members, each frame is coiled into three loops. To exert a separating force between the two wall members, an elongate arch forming member is provided having a pair of free ends, each connected to one of the wall members. The arch forming member is preferably a glass reinforced epoxy rod having helically wound fiber at its surface. The surface may take the form of a pyramid, cube or playhouse.

17 Claims, 10 Drawing Sheets

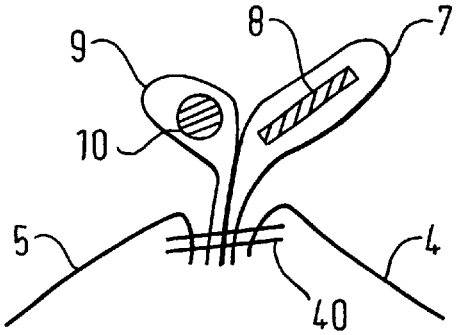
FIG. 12
FIG. 13
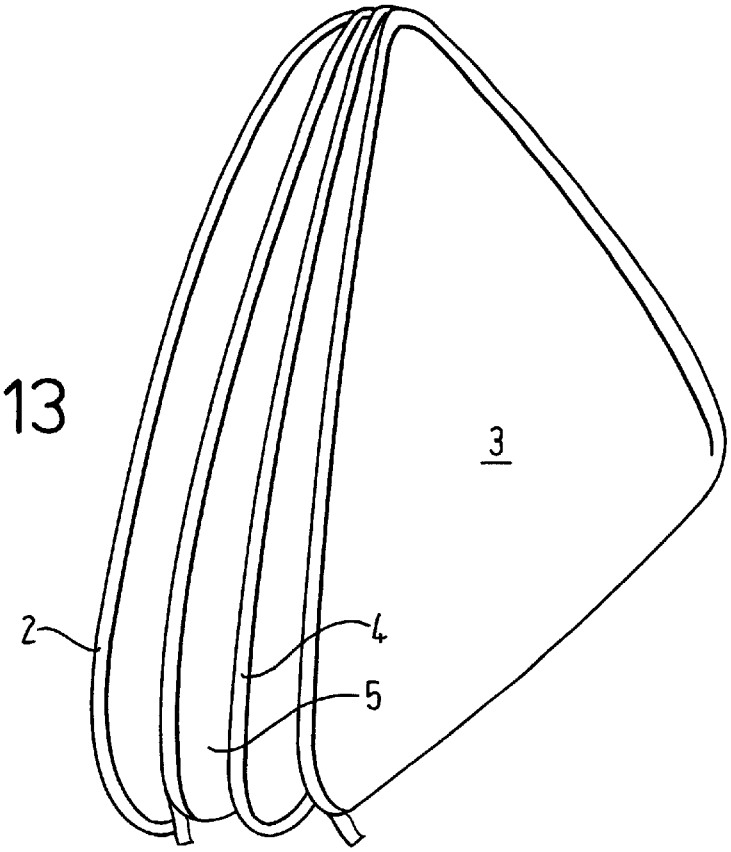
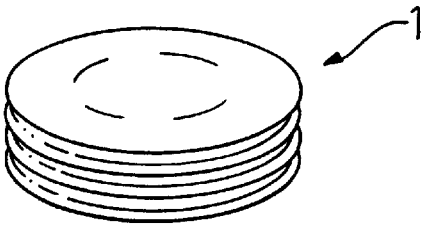
FIG. 14

COLLAPSIBLE FABRIC STRUCTURES WITH COILABLE SUPPORTS

SUMMARY OF THE INVENTION

This specification relates to collapsible fabric structures with coilable supports. Such structures may be formed from a number of fabric panels provided with coilable supports so that they can be collapsed and coiled up into a compact state for storage or transportation. They may for example be used as tents, play houses or other play structures, sun shelters, and so forth.

Many traditional tents and similar structures have been formed from fabric supported on frames comprising a number of elongate members which are joined together when the structure is erected and have to be separated when the structure is dismantled. The process of assembling a frame and attaching fabric panels to it can be time consuming, as can the reverse procedure.

For many years it has been known to provide a fabric panel with an integral coilable supporting frame in the form of a loop of spring steel strip. The loop can be coiled into three coils for storage of the panel and expands to a single coil tensioning the fabric when the panel is to be used. The advantage of such a panel is that it can be stored or transported in a collapsed state in a suitable restraint such as a bag, but will automatically expand into its functional form when released from the restraint. Such panels have been used for many purposes, such as sun shields as in U.S. Pat. No. 4,815,784, and beach blankets as in U.S. Pat. No. 4,951,333. However, the panels have been of particular use in the construction of tents, sun shelters and similar structures. U.S. Pat. No. 3,960,161, U.S. Pat. No. 3,675,667, U.S. Pat. No. 3,990,463 and U.S. Pat. No. 4,825,892 all show tents employing coilable support frames.

U.S. Pat. No. 3,990,463 and U.S. Pat. No. 4,825,892 disclose tents in which a single strip of steel is formed into a figure of eight, defining two loops and thus two panels. The two panels can be placed on top of each other and then coiled up, with each loop being coiled into three. However, tents of this type face stability problems.

U.S. Pat. No. 3,960,161 discloses arrangements in which a number of panels are used to construct a tent, each provided with its own loop which can be coiled into three. These panels may be arranged in a line or in a ring, and may abut each other or be separated by additional pieces of fabric. The panels are of an anticlastic form and, as is well known, anticlastic panels can be arranged in many ways to form structures such as tents and other shelters or more permanent structures. U.S. Pat. No. 2,961,802 shows how individual anticlastic panels can be used in several different ways, in that case the panels having e.g. inflatable frames rather than the coilable frames of U.S. Pat. No. 3,960,161.

EP-A-0 487 642 discloses a tent or similar structure in which a number of anticlastic panels are arranged in a ring, each panel having a frame in the form of a loop of spring steel strip which can be coiled into three. The panels are saddle shaped and the sides of adjacent panels diverge towards the base of the structure. A relatively small length of each panel rests on the ground. When the tent is collapsed the panels, typically three or four, are placed on top of each other and coiled up in the same manner as the two panels in U.S. Pat. No. 4 825 892. The shape of the panels in EP-A-0 487 642 is such that the structures formed are of limited practical use. The saddle shaped panels used in all of the embodiments rely upon a pronounced anticlastic effect for structural rigidity but this means that the lengths of the panels which can be joined together are limited as adjacent panels, when joined at the top, diverge lower down. In one embodiment a different panel shape is used, in which two of the four joins between panels in the structure can extend along a substantial length of the panel sides. However, the remaining two joins are along short lengths only. A pronounced anticlastic effect in the panel is necessary if the remaining unsupported panel portions are to provide sufficient structural rigidity, as in all of the embodiments described. The structures require additional means, such as interconnecting straps or a tensioned floor, between the divergent panel portions to hold them in the erect state.

GB-A-2 263 920 discloses an arrangement in which four flat, generally triangular panels are arranged in a ring, each panel having a frame in the form of a loop of spring steel strip. Each loop can be coiled into three, and to collapse the tent the panels are placed flat on each other and then coiled up. The panels do not exhibit the pronounced saddle shape of the panels in EP-A-0 487 642, and thus will be individually less rigid than panels relying upon a strong anticlastic effect. However, by using flat panels with relatively straight sides it is possible to hinge the panels together from top to bottom, so that adjacent panels support each other from top to bottom. The steel strip of adjacent frames can abut, and being at right angles will form a type of 'T' section. The preferred structure, in the form of a truncated pyramid, is more stable and more useful than the structures of EP-A-0 487 642, and has been in widespread use as a play tent. Cubic structures using rectangular panels with upright sides and having a flat top have also met with commercial success as play modules.

A problem with the tent of GB-A-2 263 920 is that the presence of four spring steel loops means that there can be difficulties when the tent is collapsed. In order to move from the erect condition to a state in which the four panels overlie each other prior to coiling, there has to be distortion of the sides of the frames of two adjacent panels. This can make it difficult to fold the panels together. Furthermore the distortion can lead to a steel strip moving to a wrong orientation in its retaining fabric channel. The forces can be such as to cause the join between the ends of the strip to be broken, thus rendering the loop ineffective. It is possible for a kink to remain in a strip prior to coiling up, the coiling operation then permanently deforming the strip in this region. Separating the join between two of the panels would enable them to be folded flat on each other, prior top coiling, without distortion. However, this introduces another step for erecting and collapsing the tent.

An object of an invention disclosed herein is to provide a collapsible fabric structure with coilable supports which in preferred embodiments avoids or alleviates at least some of these problems.

Viewed from one aspect of this invention there is provided a collapsible fabric structure, comprising first and second wall members each having a coilable frame which forms a loop defining a pair of opposed sides when the structure is expanded and which is capable of being coiled into three loops when the structure is collapsed, a side of the first wall member being connected to a side of the second wall member, characterised in that the connection between the sides of the wall members is made by an elongate arch forming member of resilient material having a pair of free ends, wherein the arch forming member is capable of being coiled when the structure is collapsed and, when the structure is expanded, forming an arch which extends from a first free end along at least part of the side of the first wall member, across to the side of the second wall member, and along at least part of the side of the second wall member to the second free end, the arch forming member exerting a separating force between the first and second wall members.

The use of an arch interconnecting the first and second wall members, as opposed to a further wall member having a frame in the form of a loop as in GB-A-2 263 920, has a number of advantages. It is easier to collapse the structure, because the arch is able to distort and move without causing any difficulties or damage whilst the structure is being collapsed and the wall members folded up on each other. It has been found that in preferred embodiments there is considerably reduced distortion of the wall members with loops, portions of the arch deflecting to enable to wall members to adopt the required configuration.

Because the arch forming members do not have to act in the same way as the loops, they do not have to be made of flat strip of steel or the like. They can for example be of circular or oval cross section and be capable of flexing in several directions, thus adding to the ease of collapsing and coiling up the structure. In the preferred embodiments, therefore, the arch forming members are capable of flexing at least in two orthogonal directions. They may for example be rods of a fibre composite material such as glass fibre or carbon fibre.

The arch forming members, such as glass fibre composite rods, need to be sufficiently strong to provide the required support for the structure but also need to be capable of coiling when the structure is collapsed. For certain structures the required coiling force may be relatively high and this may not present problems if those structures are intended for manipulation by an adult or by two people. However, for play tents and similar structures the coiling force required is preferably such that an adult or even a child can coil the structure up for storage or transportation.

Another requirement is that the arch forming members should be capable of remaining coiled for significant lengths of time without reducing their ability to form the correct arch, exerting the required forces, when the structure is erected. Depending upon the size of the structure, the arches may be coiled down to a diameter of 400 mm or less, and this can cause difficulties. Certain type of member might have tendency to retain some curvature from having been coiled up. Another problem with certain types of fibre glass composite rods is that when coiled up, the surface under tension may tend to delaminate, with fibres breaking through the surface. This can lead to reduced effectiveness.

In the preferred embodiments described herein, the arch forming members are glass fibre reinforced epoxy rods, having a helically wound surface. Such rods can provide the strength and resilience required, whilst being capable of coiling without difficulty or exhibiting the problems of certain other types of rod. Typically the rods may have about 80% by weight glass fibres and 20% by weight epoxy resin. The diameters may range from about 2 mm to 5 mm, with corresponding minimum bending diameters of 200 mm to 500 mm. In practice it has been found that for easy coiling by a single person, the rod diameters are preferably in the range of about 2.5 mm to about 3.5 mm, with preferred diameters being about 2.7 mm or about 3.2 mm depending upon the application and the structural requirements. Rods of this type are available from Sportex Gmbh of 7910 Neu-Ulm, Germany.

The profile of the arches will affect the forces provided to urge the other wall members apart and the structural integrity of the structure as a whole. An arch of a resilient rod which is simply attached between two members at its free ends, and is otherwise unrestrained, will tend to adopt a generally parabolic profile. However, in preferred constructions in accordance with the invention the arch is restrained in a channel of fabric in a similar manner to the steel strip loops on the other wall members. This will tend to straighten the lower ends of the arch as they follow the desired line down the structure, and this will not cause significant problems. However, if the top of the arch is constrained to follow a different profile, for example being flattened, then the outwardly directed force lower down the arch may be reduced. This can be compensated for by using a larger diameter rod to increase the separating force, provided that it can still be coiled up as required.

An arch with free ends requires less material than a loop enclosing a similar area, and this reduces manufacturing costs and also the weight of the item. When the structure is collapsed and the arches are coiled, they tend to form two coils due to their reduced length when used on a pyramid style tent. For the reasons discussed above, the arch does not need to be formed from spring steel strip, and indeed is preferably in the form of a flexible rod of e.g. glass fibre composite such as the helically wound rods described. This also leads to reduced weight.

Where the wall members are upwardly extending side walls of the structure, which may for example be a play tent in the form of a truncated pyramid, the free ends of the arch can also be used to support the structure at its corners. This can be done directly or for example through support feet attached to the free ends of the arch. This may provide improved stability over a tent in accordance with GB-A-2 263 920, where there is no engagement of the supporting frames with the ground at the corners of the tent.

In preferred embodiments it may be possible to construct the arch from an element which requires less bending force to coil it up than the spring steel strip typically used for the loops. This will make it easier to coil the structure and there will also be less force released when the structure is expanded from a coiled up condition.

Depending upon the application and the orientation of the wall members interconnected by the arch, it may extend in a generally upwards or in a generally horizontal direction. However, in the preferred embodiments the wall members are side walls of an upright structure such as a tent, sun shelter, play house, play module or the like. In these embodiments there are preferably four walls, two being the wall members with loops, and two being formed by an arch as described above. The free ends of the arches will be adjacent the base of the structure and as noted above preferably serve to support the structure at its corners. The arch preferably extends to an apex adjacent the top of the structure, although it could have an apex lower down the structure.

It would be possible to have additional walls, either in the form of the arch or in the form of a wall members with a loop, or in any other form. Preferably, however, the structure consists of a ring of walls which are alternately wall members having loops, and interconnecting arches - and in the preferred embodiments there are just two wall members and two arches arranged in this manner.

In other preferred embodiments, the arch forming members can be arranged the other way up with their free ends at the top of the structure. The inverted arch forming members extend from one side of a first loop to one side of a second loop along the base of the structure. If necessary, additional supports in the form of rods, inflatable tubes, expandable panels or the like may be provided at the top of the structure to strengthen this region as necessary.

Where two or more arch forming members are provided, preferably they are orientated in the same way but in certain situations, it may be more desirable to have one arranged extending across the top of a structure and one arranged as an inverted arch extending across the base of a structure. As is evident from these preferred embodiments, the term "arch" is not intended to restrict the specification to upright arches but instead refers to an arch in any orientation, for example, upside down, horizontal or inclined, the arch being a smooth curve or having generally straight sides.

The structure may be in the form of a pyramid having a relatively sharp apex, or in the form of a truncated pyramid, or may have relatively upright side walls and flat top or for example a ridge. The top of the structure may be closed by an additional panel of fabric or by other means, as with existing structures. Additional support struts maybe attached to the structure when erected, to provide support in appropriate places if needed, such as along a ridge top or between the free ends of an arch to improve stability.

At least some of the walls will include fabric portions. The wall members including the loops will preferably have fabric defining a retaining channel for the loops. However, this need not be an entire panel of fabric extending across the frame. The panel may for example have one or more apertures serving as e.g. a door or window. It may have a very substantial aperture so that the fabric forms a relatively narrow peripheral region which receives the frame. The arch may or may not be restrained by fabric in a similar manner. However, means should be provided to restrict the extent to which the free ends of the arch can move apart. This could be achieved by means of a fabric panel, or by a strap, cord or the like of predetermined length interconnecting the sides of the arch, preferably adjacent the free ends. It could also be achieved by using a tensioned floor panel. This need not be connected to the arch ends directly. For example, if a floor panel is connected between the wall members with loops, then that will restrict the extent to which they can move apart under the action of the arch as it expands. Alternatively, fixing loops or the like could be provided to peg the structure to the ground in a preferred orientation.

Whilst in the preferred embodiments the arches define walls of the structure (whether there is fabric extending across the walls or they are open) they could be used in a different configuration. Thus, instead of extending from one side wall member to another along the periphery of the structure, the arch could extend across the centre of the structure between diagonally opposite sides of the wall members. Thus, in a typical embodiment having two wall members with loops and two arches, the two arches would intersect towards the top centre of the structure.

The preferred material for the arches has not previously been proposed for use in the manufacture of collapsible structures having coilable supports. Whilst in the preferred embodiments of the invention discussed above the material is used to form the arches, it could be used in other types of structure.

Thus, according to one aspect of another invention disclosed herein there is provided a collapsible fabric structure with wall members, the structure comprising at least one coilable resilient support which can be coiled when the structure is in a collapsed condition and which will uncoil when the structure is expanded to an erect condition, the support providing at least in part a force urging the structure into its expanded, erect condition, characterised in that the support consists of a rod of helically wound glass fibre epoxy composite.

According to another aspect of this invention there is provided a collapsible fabric structure with wall members, the structure comprising at least one coilable resilient support which can be coiled when the structure is in a collapsed condition and which will uncoil when the structure is expanded to an erect condition, the support providing at least in part a force urging the structure into its expanded, erect condition, characterised in that the support consists of a rod of fibre resin composite having a diameter in the range of about 2 mm to 5 mm and a minimum bending diameter in the range of about 200 mm to 500 mm. Preferably the rod diameter is in the range of about 2.5 mm to 4 mm and the minimum bending diameter is in the range of about 250 mm to 400 mm. In certain preferred embodiments the rod diameter is in the range of about 2.5 mm to 3.5 mm and the minimum bending diameter is in the range of about 250 mm to 350 mm.

The preferred composite rods for use as supports in the inventions disclosed herein are preferably of substantially circular cross section. They are preferably of constant cross section along their length. However, they could taper towards their free ends, for example increasing in diameter to provide additional support. They could be made from sections joined together, and these could be of different diameters to provide a tapering effect. Preferably, however, the rods used, and particularly those used to form arches, are one piece and continuous from one free end to the other.

Another type of structure to which these arch forming members have application is a collapsible goal. It is already known to hinge three coilable loops together to form a collapsible goal structure, such as from UK Registered Designs 2072126 and 2076801. The loops are generally of a rectangular form when expanded and are hinged to the next along their long edges to form a generally triangular prism shape having two sides and a base. One of the sides is open when the structure is to be used as a goal. Other structures are known where the open side is closed off with a panel of fabric to form a tent, for example, from U.S. Pat. No. 5778915.

According to yet another aspect, the present invention provides a collapsible fabric structure, comprising three wall members forming two sides and a base, wherein first and second wall members each have a coilable frame which forms a loop when the structure is expanded and which is capable of being coiled into three loops when the structure is collapsed, the first and second wall members being hinged together along one edge, characterised in that the third wall member has an elongate arch forming member of resilient material having a pair of free ends, wherein the arch forming member is capable of being coiled when the structure is collapsed and, when the structure is expanded, forming an arch which extends between the first and second wall members to hold the edges of the first and second wall members which are not hinged together, in a spaced relationship to each other.

The arch forming member is preferably positioned in a base and the loops arranged as the sides. In such an embodiment, the arch forming member would be orientated in a horizontal plane when the structure is in normal use. However, the arch forming member may also be used in a side with one loop used in the other side and the other loop used in the base.

The arch forming member may extend from a first free end, along one edge of the first wall member, across to the second wall member, along one edge of that second wall member to a second free end. In another arrangement the arch forming member extends from a first free end adjacent the first wall member across to the second wall member, along one edge of the second wall member and across to the second free end adjacent the first wall member. Preferably one side of the structure is left open if it is to be used as a goal and both sides are closed off with a panel of fabric, possibly with openings to permit access, if it is to be used as a tent.

In one improvement of this arrangement, the arch forming member is made longer so that its free ends lie part way along the side of a loop, i.e. the arch forming member includes an additional curve at each end so that the free ends follow the line of the side of the loop or are substantially parallel to the side of the loop. In practice, due to the inherent flex of the structure it is unlikely that the free end will lie fully parallel with the side of the loop and instead tends to adopt a position of, say, up to 30°, but preferably less than 20°, more preferably less than 15°, off the parallel position. The extra curve in the arch forming member introduces additional resilient forces into the structure. Preferably these are sufficient to cause the structures to self-expand once it has been removed from its storage bag and allowed to expand, for example, by being tossed in the air. The goals of UK Registered Designs 2072126 and 2076801 have been a huge commercial success because they can be erected quickly, typically within five to ten seconds. In the preferred embodiment described above, the structure may be erected within 1 to 2 seconds. There are no additional construction stages such as connecting hinges. To collapse the structure, the loops are pushed flat together and then coiled up into 3 loops as before, in so doing the arch forming member automatically coils to approximately the same radius.

Thus viewed from yet another broad aspect, there is provided a collapsible fabric structure comprising two wall members, each having a coilable frame which forms a loop when the structure is expanded and which is capable of being coiled into three loops when the structure is collapsed, the wall members being hinged together along a common edge, wherein the opposite edges of the wall members are urged apart, forcing the structure into its expanded, erect condition, by a coilable resilient support extending between the wall members, characterised in that the coilable resilient support has a pair of free ends which are arranged to lie in a direction approximately parallel to the hinge of the two wall members and in that the structure is self erecting.

Preferably the two wall members comprise sides of the structure and the coilable resilient support is provided in a base comprising a further wall member, but other embodiments are envisaged where the coilable resilient support is used in a side and the loops are located in a side and a base. A side may be left open if the structure is to be used as a goal and closed with fabric if it is to form a tent. In certain applications, it may be desirable to have the structure stood on one end in use so that the three wall members form the three sides.

The coilable resilient support may comprise a single length of rod which extends from one free end, which is located adjacent to and arranged substantially in line with a side of the loop of a first wall member, across to the second wall member and along one side of the loop of that wall member, and back across to the first wall member to a second free end which is located adjacent to and arranged substantially in line with the side of the loop of the first wall member, the second free end pointing substantially toward the first free end. In another embodiment, two coilable resilient supports are provided, each having a pair of free ends, the first free end of each coilable resilient support being located adjacent to and arranged substantially in line with a side of a loop of one of the wall members, and the second free end of each coilable resilient support being located adjacent to and arranged substantially in line with a side of the other loop of the other wall member. Preferably the two coilable resilient supports are arranged along opposite edges of a third wall member, but other arrangements are envisaged where the coilable resilient supports bow in other directions or cross, the only requirement being that the structure is able to expand by itself.

Previously, it was thought that collapsible structures, having odd numbers of panels or wall members arranged in a ring needed to have a hinge which was detachable, for example by means of zip, hook type material or the like, so that the panels could be folded flat over each other prior to being coiled up. However, it has been found that by incorporating a coilable resilient support having a pair of free ends into at least one of the those panels or wall members to replace the conventional coilable frame loop, it is possible to collapse and expand the structure without needing to detach a hinge holding together two of panels or wall members, resulting in structures which are simpler and quicker to erect.

According to yet another invention disclosed herein, there is provided a collapsible fabric structure having an odd number of wall members arranged in a ring, each being hinged to the next along one edge, characterised in that one of the wall members includes a coilable resilient support having a pair of free ends and in that all the wall members are permanently hinged to their adjacent wall members.

Viewed from another aspect, this invention provides a method of collapsing a collapsible fabric structure having an odd number of wall members arranged in a ring, each being hinged to the next along one edge, characterised by folding the wall members flat on top of each other to form a stack of wall members without unhinging any of the edges, and then coiling the stack of wall members into three overlaying loops.

This invention has been found to work best when there are only three wall members, although it is applicable to situations where there are more wall members, for example, five or seven wall members. Preferably the ring of wall members is a ring when viewed from above, but could also be a ring when viewed from the side, for example, as with the goal discussed above.

The purpose of the coilable resilient supports having the free ends (the arch forming members) in all of the embodiments described is to urge the wall members apart, pushing the structures into their fully expanded condition. The force created to achieve this is provided by the coilable resilient support (which in an unrestrained state would adopt a straight line) being bent into a curve, with the tighter the radius of the curve, the greater the force exerted on the structure. Generally speaking the force is exerted where the curve finishes or for a short length thereafter. This is particularly so in the embodiments where this point corresponds with a free end, which unlike a loop is free to flex towards its straight line condition, only being restrained by the fabric of the structure.

In some embodiments it is preferred to use, say, two short lengths of coilable resilient support at opposed edges of a wall member. In this way, the coilable resilient supports, which are restrained by the fabric of the collapsible structure into a curve so that each of the free ends of one coilable resilient support generally point to the corresponding free ends of a second coilable resilient support, thereby urging the structure into its fully expanded condition.

In one embodiment, therefore the structure comprises four wall members which are arranged in a ring, wherein a first and a second wall member, which are arranged opposed to each other, have a coilable frame which forms a loop defining a pair of opposed sides when the structure is expanded and which is capable of being coiled into three loops when the structure is collapsed, a first side of the first wall member being connected to a first side of the second wall member by a third wall member and a second side of the first wall member being connected to a second side of the second wall member by a fourth wall member, characterised in that the third and fourth wall members each have two coilable resilient supports which extend between the first and second wall members to urge the first and second wall members apart and force the structure into its fully expanded configuration, with each coilable resilient support having a first free end located adjacent to and substantially in line with one side of the first wall member and a second free end located adjacent to and substantially in line with one side of the second wall member.

Preferably the free ends of the coilable resilient supports are located adjacent to the start and finish points of the opposed sides of the first and second wall members, i.e., close to the point where the substantially straight sides begin to curve. Preferably, the coilable resilient supports are arranged along the top and bottom edges of the third and fourth wall members.

The collapsable structure may take the form of any of the four sided structures described above, for example, a pyramid, a truncated pyramid, a box shape or cube like structure.

The coilable resilient supports may be as arches in conjunction with wall members including loops, as described above. However, the supports may also be used to construct a simple, lightweight structure without the need for any additional supports of other material. Thus, one preferred structure has a plurality of supports in the form of intersecting arches, forming a generally dome or "igloo"—like structure. The free ends of the arches provide support at the base of the structure. Two, three or more arches, intersecting at an apex, may be used as desired to provide sufficient strength. Additional members, also the preferred rods may be added to increase strength or to alter the shape of the structure.

A simple dome type tent with intersecting arches is simple to assemble, springing easily to its erect condition, and easy to collapse because there is no need to go through the specific operation required to coil loops of flat steel strip into three.

Thus, according to a further aspect of this invention there is provided a collapsible fabric structure for erection on a base, comprising a plurality of coilable, resilient supports which can be coiled when the structure is in a collapsed condition and which will uncoil when the structure is expanded to an erect condition, the supports providing at least in part a force urging the structure into its expanded, erect condition, characterised in that the supports consist of rods of helically wound glass fibre epoxy composite material which form arches intersecting adjacent the top of the structure when in the erect condition, with free ends of the arches engaging the base.

Such a structure has a number of advantages. Using only the composite material for the supports results in a lighter and less expensive structure. It will expand immediately when released from a restraint such as a bag, without the need to unfold panels as in the structure of GB-A-2 263 920. Both the force of expansion and the force required to collapse the structure may be significantly less than with structures using steel loops.

In another embodiment, the coilable resilient supports which constitute the arches are arranged so that they do not intersect at an apex. Each arch member has two free ends positioned to provide support to the base of the structure. The arches extend from their free ends upwardly along the opposed side edges of the side panels to the top of the structure. Preferably the arches touch at the top of the structure and form an apex or a ridge. In a four-sided structure, two arches would be provided, each in one of two side panels that are arranged opposite each other. In a six-sided structure having a hexagonal base, three arches would be present. Fabric may extend across and between the side panels having an arch to enclose the structure or certain side panels may be left open or provided with openings as desired. The panels having an arch would thus alternate with panels having no arch. To tension fabric positioned between the panels having the arch and to provide rigidity to the structure, a base panel may be provided having a coilable frame member in the form of a loop, preferably formed of spring steel strip, which is coilable into three smaller loops.

In one preferred arrangement, a four-sided collapsible tent is provided having a substantially square or rectangular coilable frame in the form of a loop in a base panel and four side panels, two of which include a resilient coilable frame member in the form of an arch having a pair of free ends. The free ends of the arch forming members are positioned at the corners of the base panel to provide stability and the top of the arches touch to create an apex for the tent. If preferred, the arches could be constrained to provide a flat side at the top of the structure. If these are positioned to touch each other, they can create a ridge. This type of arrangement may be used to create a ridge tent type structure or even a goal.

Thus viewed from yet a further aspect, there is provided a collapsible fabric structure having two sides and a base, wherein the base panel comprises a coilable frame which forms a loop defining a pair of opposed sides when the structure is expanded and which is capable of being coiled into three loops when the structure is collapsed and the two sides each comprise a coilable resilient support in the form of an elongate arch forming member having a pair of free ends, each arch forming member extending from a first free end located at the base of the structure upwardly along an edge of one side, around a top of the side and down an opposed edge of the side to a second free end located at the base of the structure.

An advantage with this arrangement is that the structure may be constructed to be virtually self- erecting upon removal from a storage bag, perhaps at most requiring a small flick or shake to encourage the frame members to spring out of their coiled configuration and cause the structure to self expand. To collapse the structure, an arch member is folded against the loop frame member and the structure is coiled up so that the loop frame member adopts three loops of smaller radius. In so doing, the arch members coil up to match the radius of these loops, but being of shorter length, will not form three overlaying loops. In a structure such as this where there are an odd number of panels having a coilable frame either in the form of an arch or a loop, it is not necessary to provide detachable connections along any of the connecting edges.

It is also envisaged that modifications such as changing the position of the loop and arches would be possible, for example, a loop could be used in a side panel and two arches could be used, one in a base and one in a side panel opposed to the loop. However, this has the disadvantage that the aesthetic symmetry of the design may be lost. It may also be appropriate in certain situations to position the free ends of the arches not at the corners of the loop frame member but, say, midway along the sides. Tension in the fabric may also encourage the side panels to adopt a curve, for example, to form an "igloo" type structure, rather than present flat sides.

It will be appreciated that there may be many variations of the inventive concepts and specific embodiments referred to herein.

Various embodiments of the above inventions will now be disclosed by way of example only and with reference to the accompanying drawings, in which:

BRIEF DESCRIPTION OF THE DRAWINGS

FIG. 12 is a cross section through the join between two side panels;

FIG. 13 illustrates how the tent of FIG. 1 is folded up prior to coiling;

FIG. 14 illustrates the tent of FIG. 1 in the coiled state;

DETAILED DESCRIPTION

Figure 1:
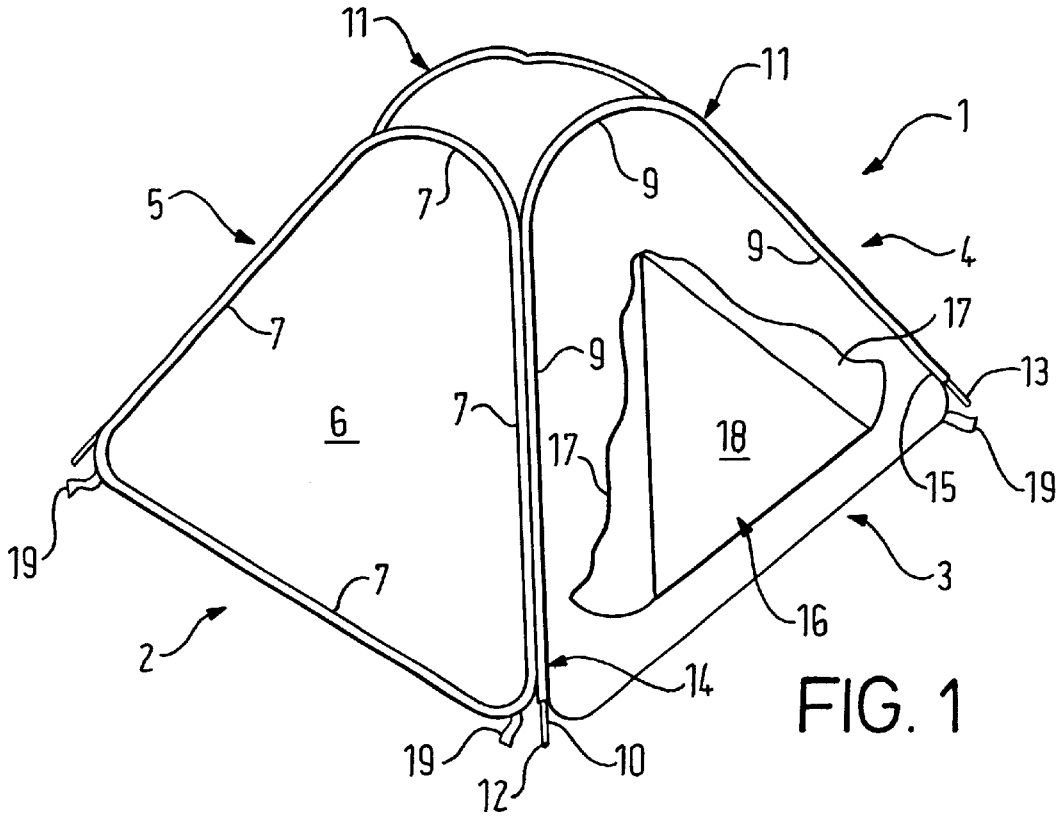
FIG. 1 is a perspective view of a tent in accordance with the present invention.

As shown in FIG. 1, a play tent 1 comprises four generally triangular side panels 2, 3, 4 and 5 hinged together along their edges to form a ring, the resultant structure having the form of a truncated pyramid. Opposing side walls 2 and 4 each comprise a fabric panel 6 provided with a peripheral channel 7 extending around the entire periphery of the panel, in which is disposed a single continuous loop 8 (see FIG. 8) of flat cross section spring steel strip. This holds the panel taut. The panels 2 and 4 are similar to those in GB-A-2 263 920. Panels 3 and 5 each comprise a fabric panel provided with a channel 9 extending only along the two sides and the top of the panel. In this channel 9 is disposed a single continuous rod 10 of a resilient, helically wound glass fibre epoxy composite material, which thus forms an arch 11 extending from free end 12, through the channel 9 to free end 13. The four free ends, 12 and 13, form feet for the tent at the corners. The resilience of the arch 11 urges its legs 14 and 15 apart, thus tensioning the fabric of the panel and also forcing apart the panels 2 and 4, thus combining with the loops 8 in the panels 2 and 4 to hold the structure in an expanded, erect condition. The legs 14 and 15 of the arches 11 may engage the side portions of loops 8, so as to restrict deformation of these outwardly in the plane of the panels 2 and 4.

Side panel 3 is provided with an opening 16 having closure flaps 17, this giving access to the interior of the tent. The tent also has a floor 18. At its four corners the tent is provided with four tabs 19, which can be used to peg the tent out to maintain its shape. These could be in the form of hook type strips (such as 'Velcro', Registered Trade Mark) which will engage with a carpet if the tent is used indoors.

The tendency of the arches 11 to spring apart is limited by the fabric of the panels 3 and 5, and if required by the floor 18 or the tabs 19.

Figure 2:
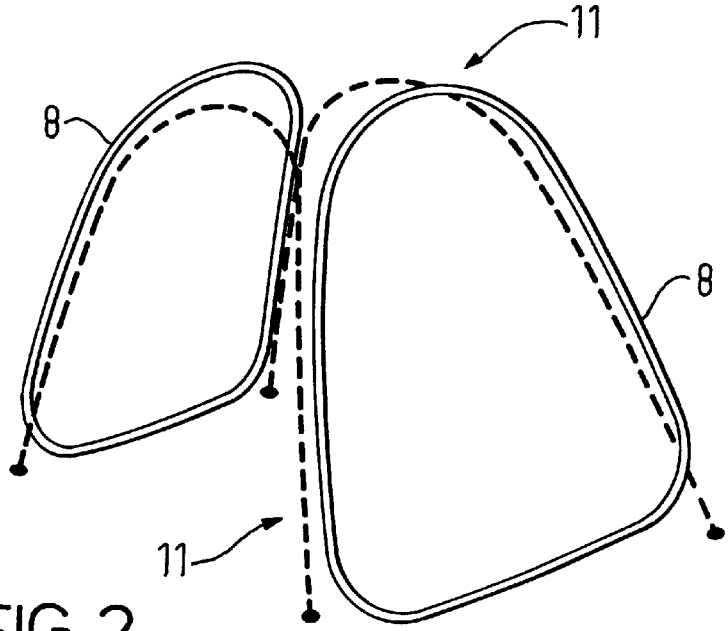
FIG. 2 is a perspective diagrammatic view of the tent showing how the loops and arches are arranged.

FIG. 2 shows in diagrammatic form the arrangement of the loops 8 and arches 11, viewed at ninety degrees from the position of FIG. 1.

Figure 3:
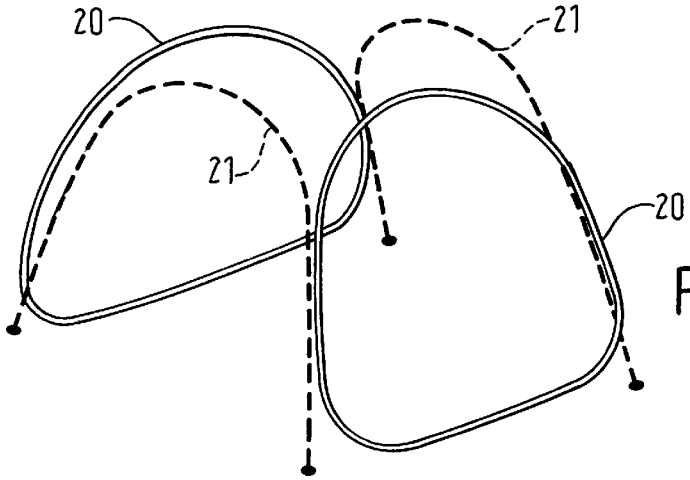
FIGS. 3, 4, 5, 6, 7, 8, 9, 10 and 11 are diagrammatic views showing alternative structure shapes.
Figure 4:
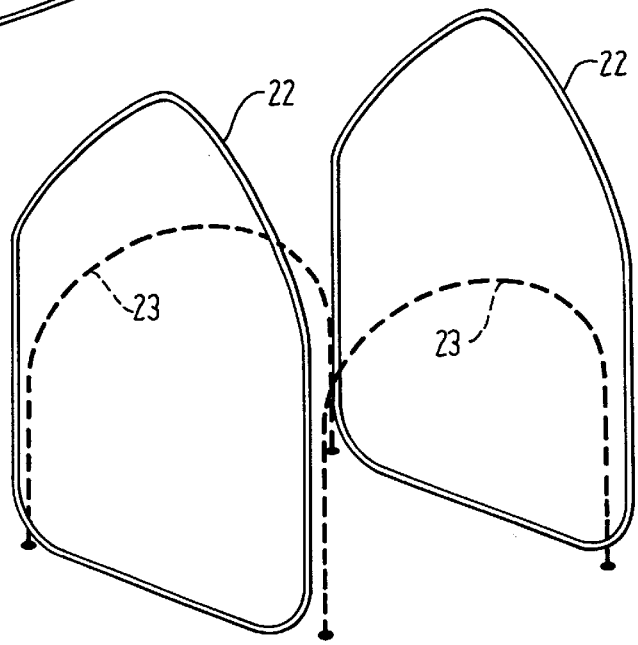
Figure 5:
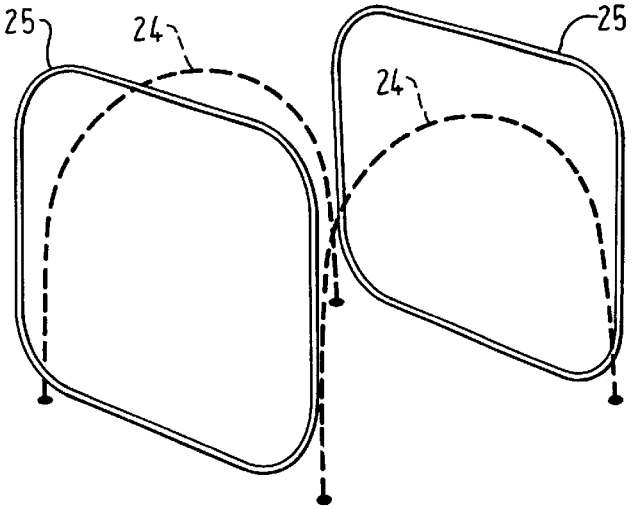
Figure 6:
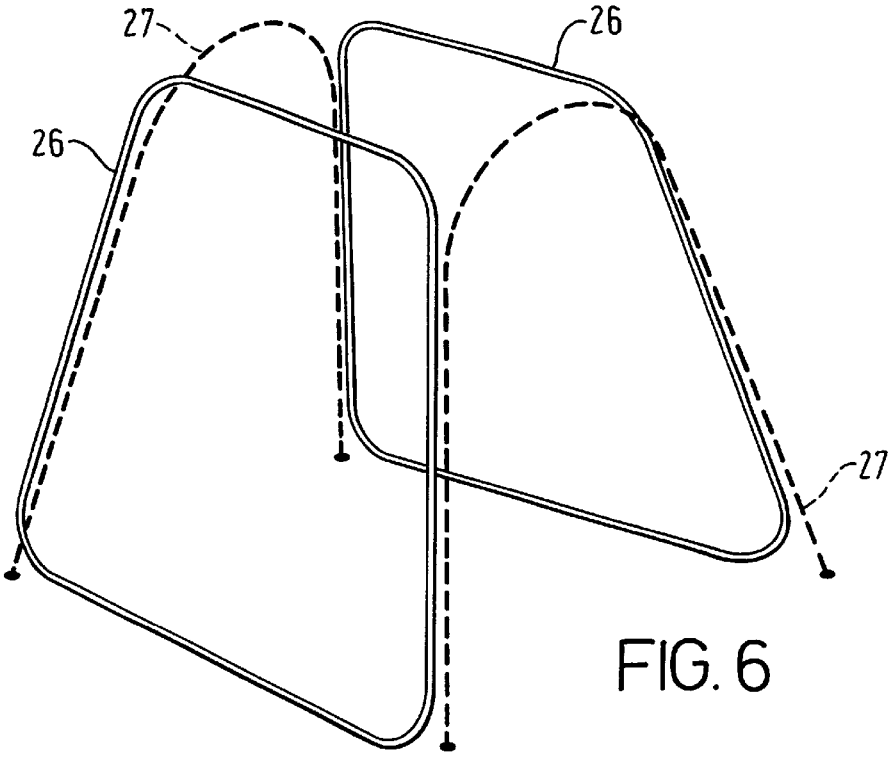
Figure 7:
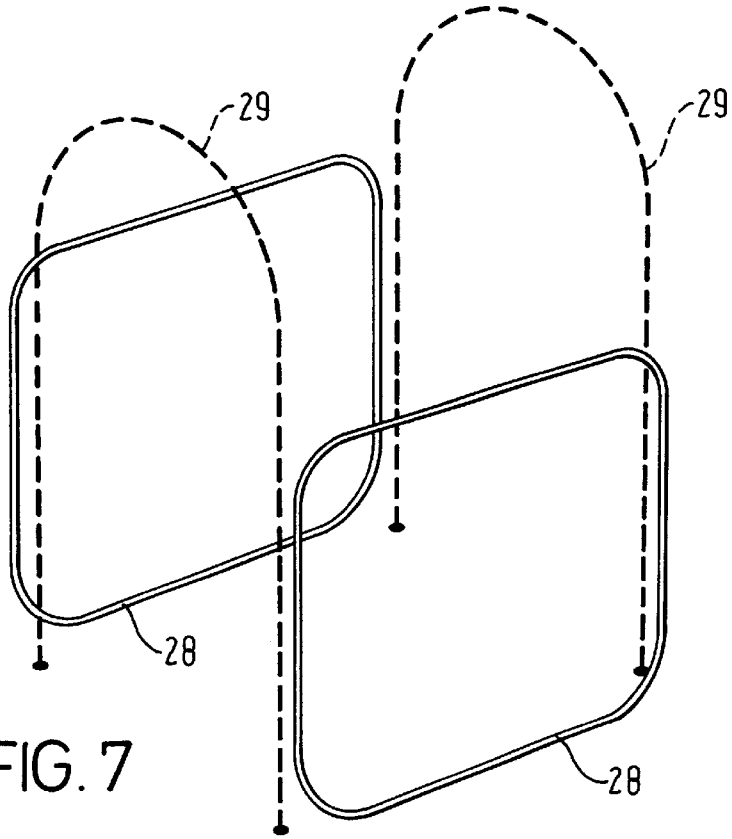

FIG. 3 shows an alternative arrangement of loops 20 and arches 21, both of which in this embodiment have more rounded upper portions. FIG. 4 shows another arrangement in which loops 22 have rectangular bases and then taper to their upper ends so that in the tent a ridge will be formed between them. The arches 23 in this embodiment have relatively flat tops and do not extend as high as the loops 22. In FIG. 5, the arches 24 are of similar configuration, but the loops 25 form squares. The resulting structure will be in the form of a cube which can be used as a play module. In FIG. 6 the loops 26 are generally rectangular with tapering sides, whilst the arches 27 are in the form of relatively tall parabolas. In FIG. 7, the loops 28 are square as in FIG. 25, but the arches 29 extend above the tops of the squares.

Figure 8:
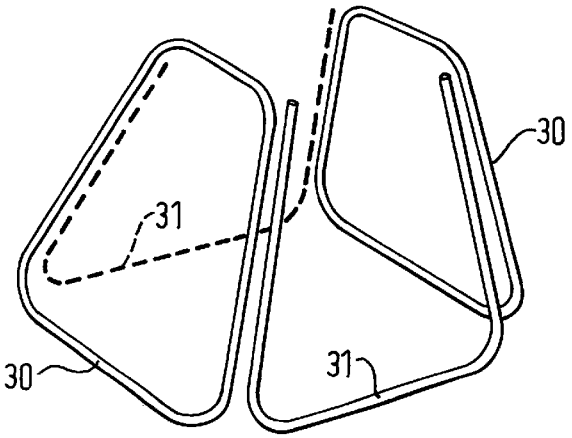
Figure 9:
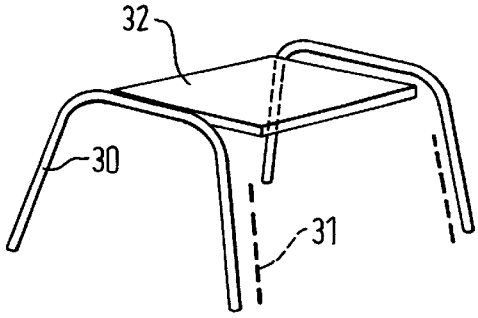

FIG. 8 shows an alternative to the arrangement of loops and arches shown in FIG. 6. The structure has two loops 30 and two inverted arches 31, the arches 31 being arranged the opposite way up to the embodiment of FIG. 6 extending in part along the base of the structure. It may be desirable in certain situations to include additional support at the top of the structure. This can be achieved, for example, using rods or inflated tubes, but may be achieved as shown in FIG. 9 by means of an expandable panel 32. This may be hinged to the structure to prevent it coming loose or being lost.

Figure 10:
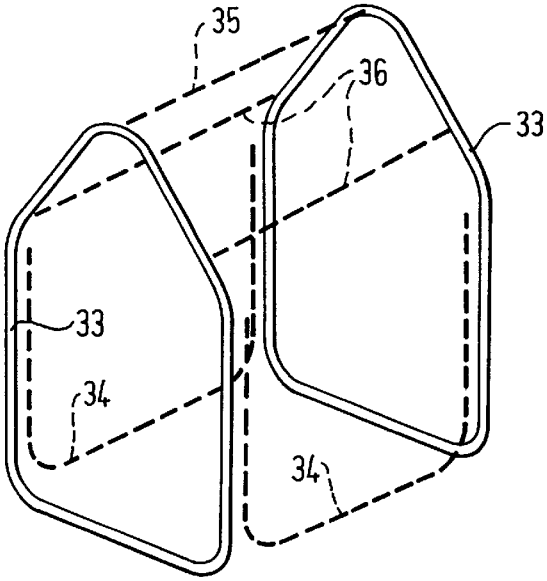

FIG. 10 shows an alternative to the arrangement of FIG. 4, the structure having two loops 33 and two upside down arches 34. A support rod 35 may be used at the ridge to provide additional support, or further down the roof of the structure as shown at 36.

Figure 11:
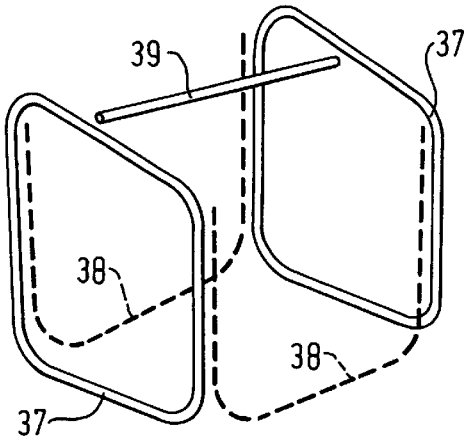

FIG. 11 shows an alternative to the arrangement of FIG. 5, the structure having two loops 37 and two inverted arches 38. Additional rods 39 may be used at the top of the structure to provide extra support.

FIG. 12 shows the join between the sides of two panels 4 and 5. In the fabric channel 7 can be seen the steel strip 8, and in fabric channel 9 can be seen rod 10. The channels are formed and the panels joined together by stitching 40.

FIG. 13 shows how the four panels 2, 3, 4 and 5 are folded flat on each other prior to coiling. The panels 2 and 3 are on the outside, and the panels 4 and 5 are on the inside. From this position the panels can be coiled up to the configuration shown in FIG. 14, using the technique described in GB-A-2 263 920, which is incorporated herein by way of reference. The metal loops 8 coil into three, but the rods 10 only coil into two, as they are shorter by the length of a side of the tent.

Figure 15:
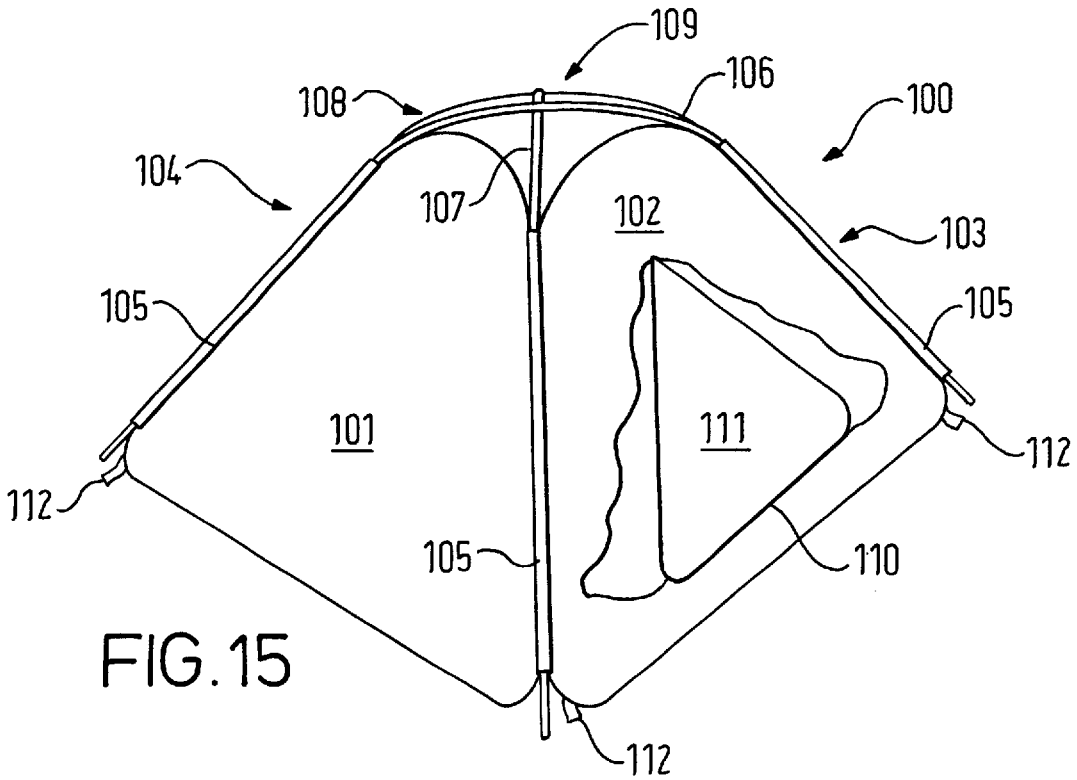
FIG. 15 is a perspective view of an alternative type of tent.

FIG. 15 shows an alternative tent 100, having four generally triangular fabric panels 101, 102, 103, 104 joined together in a ring by stitching along their sides. Four channels 105 are provided where the panels join, extending up the edges of the tent from the bottom to adjacent the top. Two rods 106 and 107 are provided, extending through the channels 105 to form intersecting arches 108 and 109, the intersection being at the apex of the tent. The rods 106 and 107 are of circular cross section helically wound glass fibre epoxy composite as in the tent described in detail above, but of course the arches 108 and 109 extend diagonally across the tent rather than along the sides. There are no metal loops. As in the previous embodiment, the tent has an opening 110, a floor 111 and tabs 112 at the four corners.

The tent can be collapsed to four overlapping panels in the same manner as the tent of the previous embodiment, but the absence of any loops makes this easier. The rods 106 and 107 can then be coiled up as desired, and the tent compacted for storage or transportation, there being no restrictions being imposed by metal loops which can only be coiled into three. When unpacked, the tent will expand readily to its erect condition, without any need to unfold panels as in the preceding embodiment or in GB-A-2 263 920.

The preferred rods for use as the arches in the embodiments above are from Sportex GmbH, and typical rods used are as follows:

| Product | Diameter (mm) | Minimum Bending Diameter (mm) |
|---|---|---|
| 68.020 | 2.0 | 200 |
| 68.021 | 2.1 | 210 |
| 68.024 | 2.4 | 240 |
| 68.025 | 2.55 | 255 |
| 68.027 | 2.7 | 270 |
| 68.030 | 3.0 | 300 |
| 68.031 | 3.1 | 310 |
| 68.040 | 4.0 | 400 |

In the preferred embodiments, product 68.025 has been found suitable for many purposes.

Figure 16:
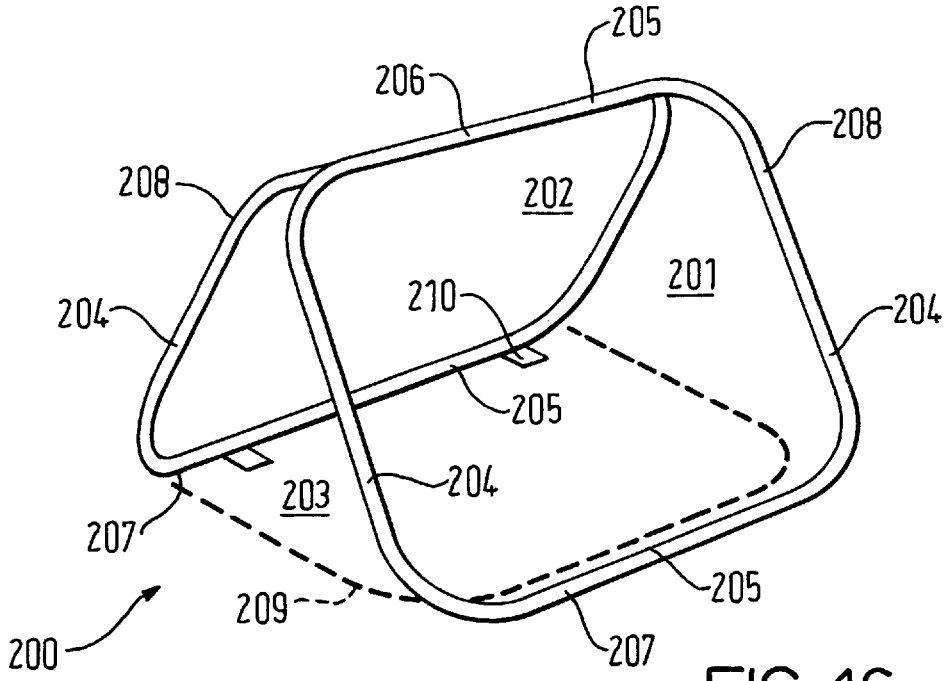
FIG. 16 is a perspective view of a further collapsible structure.

FIG. 16 shows a collapsible structure 200 which may be used as a goal or tent. The structure has three wall members in the form of two sides 201, 202 and a base 203. The wall members are generally of rectangular shape having short and long edges 204, 205. The two wall members 201, 202 defining the sides of the structure are hinged together at the ridge 206, i.e. along a long edge 205 running along the top of the structure 200. The bottom edges 207 of the wall members 201, 202 are held in a spaced relationship by the third wall member 203 which defines the base of the structure. In the embodiment shown, the two wall members 201, 202 each have a coilable loop 208 and the wall member 203 has an elongate arch forming member 209 arranged on its side in a horizontal orientation. Along one long edge 205, hook type material 210 (or other form of releasable connecting means) is used to create a hinge. This allows that edge 205 to be disconnected, enabling the wall members 201, 202 and 203 to be folded flat on top of each other and coiled up as shown in FIGS. 13 and 14.

Figure 17:
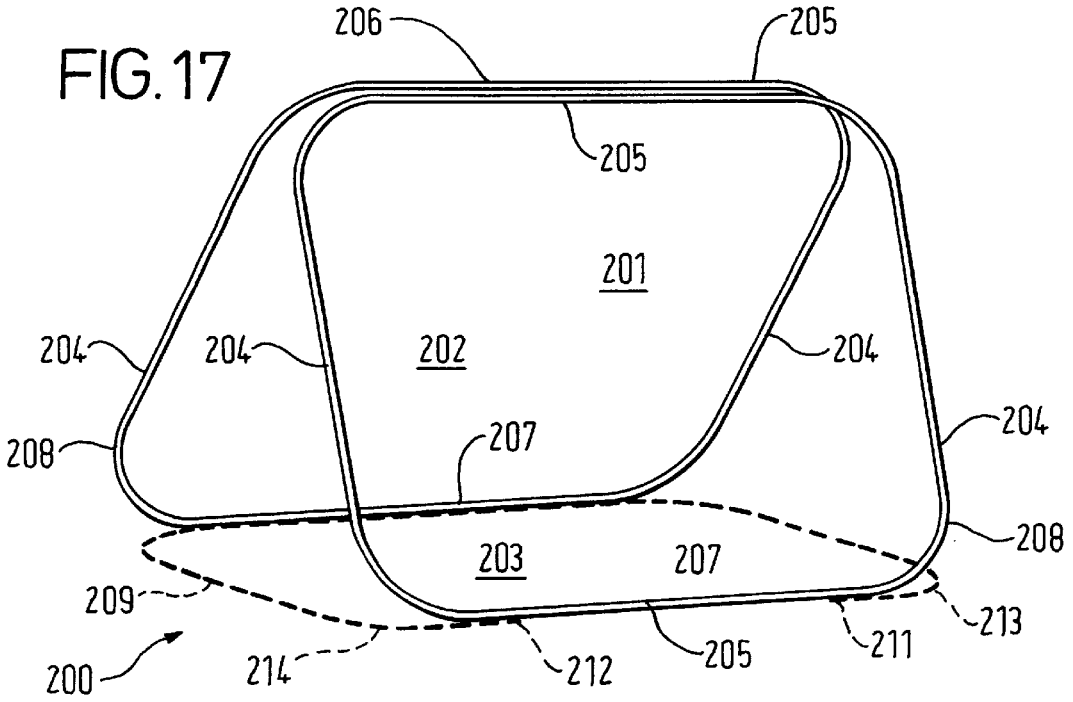
FIG. 17 is a perspective view of another embodiment which is similar to FIG. 16.

FIG. 17 shows a modification to the embodiment of FIG. 16, in which the coilable resilient support or arch forming member 209 extends slightly further and is bent close to its free ends 211, 212 so that the free ends 211,212 lie not only adjacent to but also generally in line with a side 205 of the wall member (the bottom edge 207 of the side wall member 201 in the embodiment shown), which is preferably an elongate side 205. The additional bends 213, 214 in the coilable resilient support 209 provide a number of advantages. Firstly, the additional bending of the support 209 from its straight line position introduces additional flex which creates more force for urging the two side wall members 201 and 202 apart at their bottom edges 207. Another advantage is that because the coilable resilient support 209 extends from its free ends 211, 212 generally in line with a side 205 of a wall member 201, the support 209 is able to coil automatically as the structure 200 is coiled up.

Figure 19:
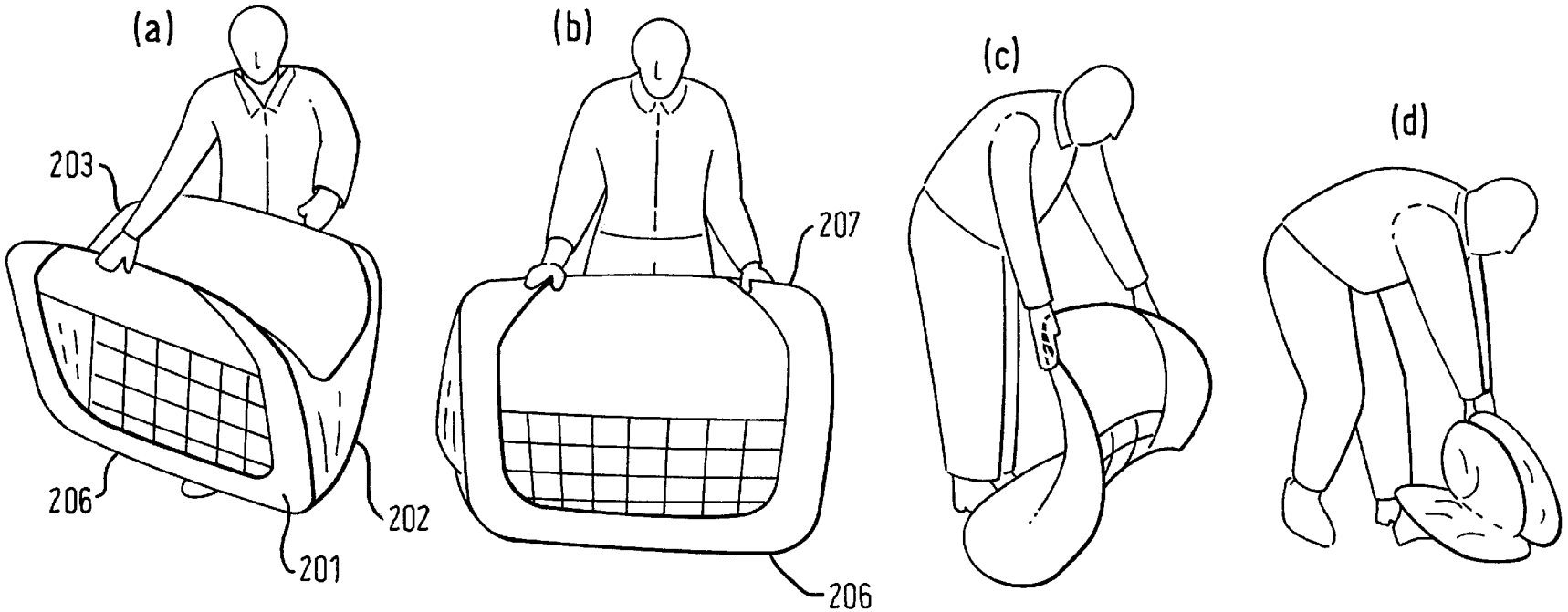
FIG. 19 shows four steps labelled (a) to (d) for collapsing the structure of FIG. 18.

The coiling up procedure is shown more clearly in FIG. 19. Step (a) shows the two side wall members 201, 202 being folded to lie flat together. This is most easily achieved by standing the structure 200 upside down on its ridge 206. The base wall member 203 folds into the structure during this step.

Holding the two bottom edges 207 of the side wall members 201 and 202 pinched together as shown in step (b), the side wall members 201, 202 are coiled up into three loops as shown in steps (c) and (d) to create a package of approximately one third size. During the coiling steps of (c) and (d), the coilable resilient support 209 in the base wall member 203 coils automatically to substantially the same radius as the loops 204 of the side wall members 201, 202. Due to its shorter length, however, the coilable resilient support 209 does not form three loops when coiled.

Figure 18:
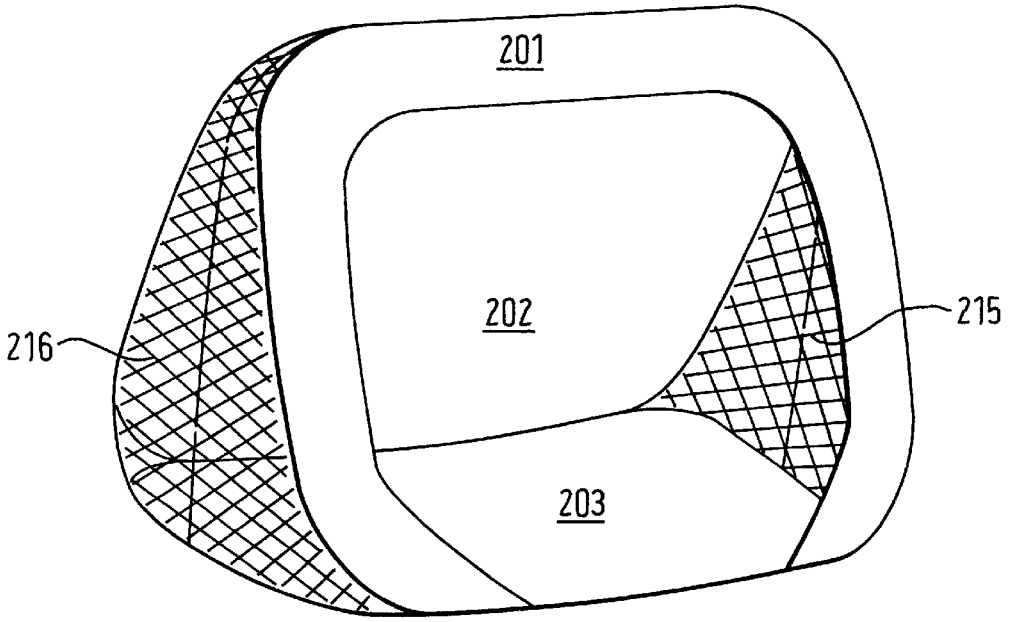
FIG. 18, is a perspective view of a goal having the structure of FIG. 17.

A goal having the structure of FIG. 17 is shown in FIG. 18. The wall member 201 is substantially open for use as a goal mouth. Netting is provided at the ends 215, 216. As discussed above, an advantage with this embodiment is that upon removing the goal in a coiled up condition from a storage bag, the structure will self-expand to form the goal shown in FIG. 18 with no further action required by the user apart from possibly a slight shake of the frames to ensure the structure is fully expanded or to start the self expansion. The goal can be erected in as little as one or two seconds. Loops may be provided for pegging the structure down in windy conditions or pockets may be provided which can be filled with sand for use on a beach. The frame structure may also be used in applications where the collapsible structure is a tent or other three dimensional structure.

Figure 20:
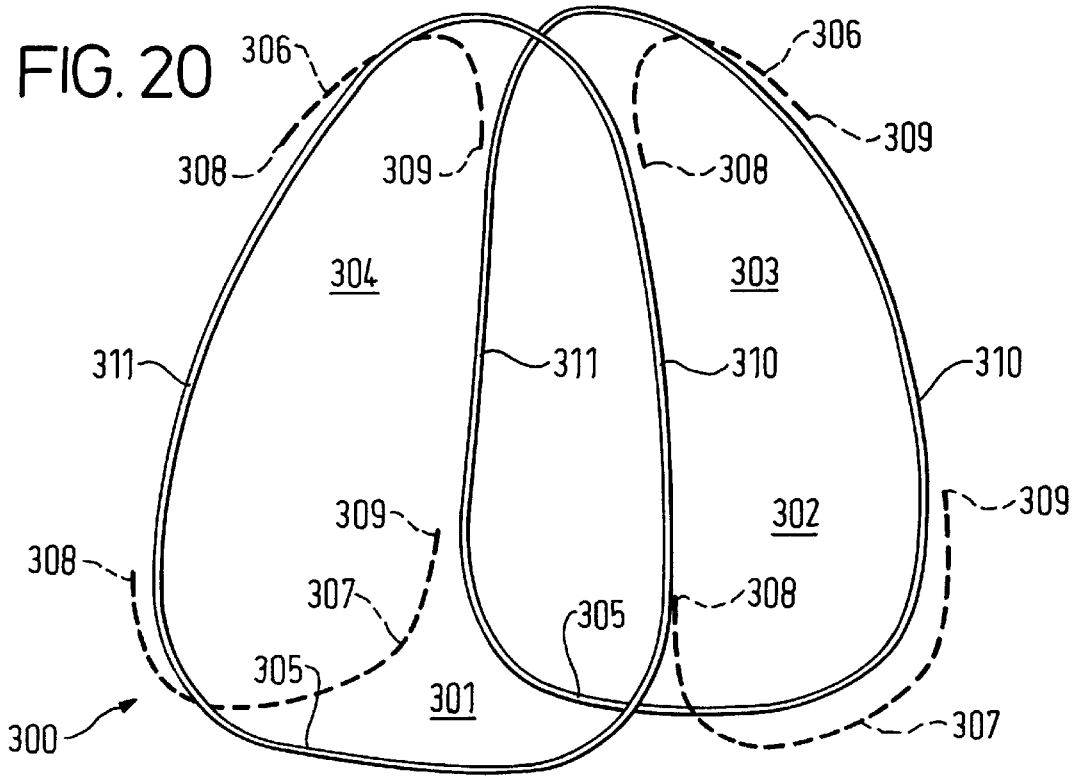
FIG. 20 shows a further embodiment of a collapsible structure.

FIG. 20 shows a further embodiment of a collapsible structure 300 having four wall members 301, 302, 303, 304 arranged in a ring. Two of the wall members 301, 303 have a frame in the form of a coilable loop 305. The other two wall members 302, 304 each have two coilable resilient supports 306, 307 which extend across their top and bottom edges to urge the structure into its fully expanded configuration. Each coilable resilient support 306, 307 is bent through an angle of greater than 90°, preferably greater than 120°, and in the case of the bottom coilable resilient supports 307, as much as 150°, preferably 180° or most preferably more, up to a maximum of about 270°. In the truncated pyramid structure shown in FIG. 21, the upper coilable resilient supports 306 form the top or apex of the substantially triangular wall members 302, 304 and the lower coilable resilient supports 307 form the bottom or base of the wall members 302, 304.

To collapse the structure 300, the wall members 301, 302, 303, 304 are folded flat against each other, and coiled up as shown in FIGS. 13 and 14. Using the coilable resilient supports 306, 307 in place of the loop frame members of GB-A-2 263 920 is advantageous because it is easier to fold the wall members flat against each other. In the structures of GB-A-2 263 920, the loop frames have to "buckle" as they are pushed through towards each other. The coilable resilient supports 306, 307 provide greater flexibility, enabling the wall members having the loop to fold flat with the minimum of distortion and buckling. This means it is less likely for the strip material of the loop to become twisted or break.

Figure 21:
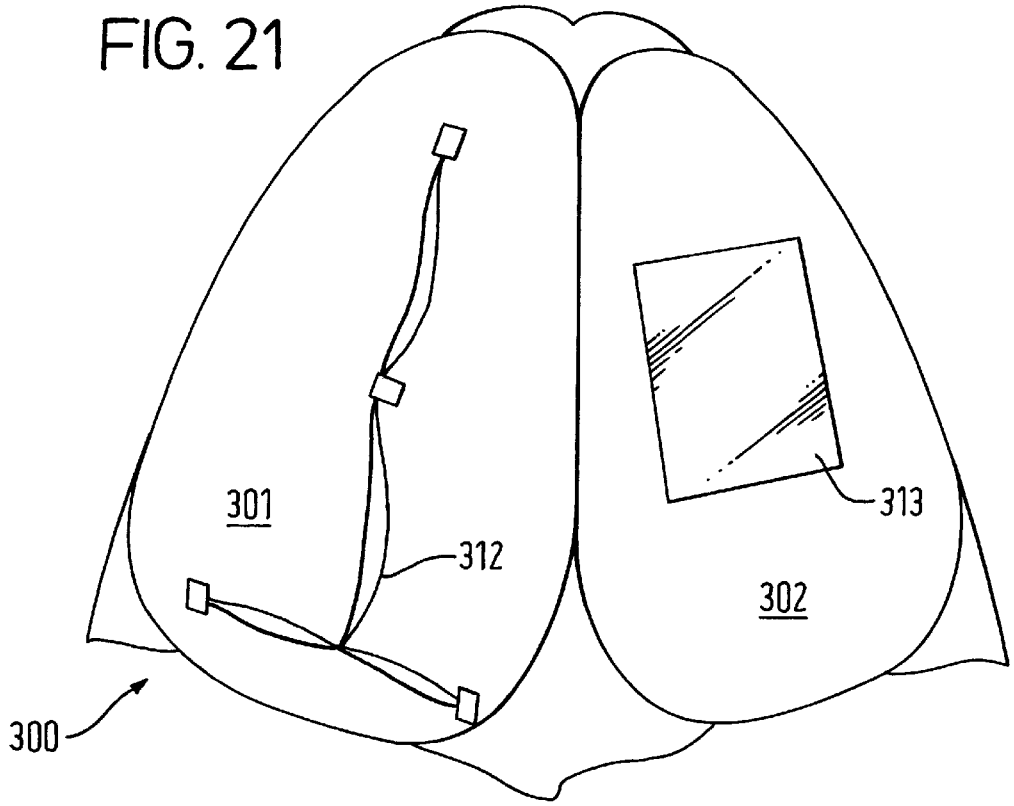
FIG. 21 shows the structure of FIG. 20 when embodied in the form of a truncated pyramid style tent.

As shown in FIG. 20, it is important that the free ends 308, 309 of the coilable resilient supports 306, 307 are arranged to lie adjacent to and substantially in line with the side 310, 311 of the wall members 301,303 having the loops 305 in order to allow the wall members 302, 304 to hinge freely. The free ends 308, 309 may be located part way along the sides 310, 311, but are preferably located at the start and finish of the sides 310, 311, since this reduces the amount of material required for the coilable resilient supports 306, 307 and reduces material costs. Preferably the coilable resilient supports 306, 307 are located within the top and bottom third of the structure, most preferably within only the top and bottom quarter of the structure 300. The preferred material for the coilable resilient supports 306, 307 is the rod material described above from Sportex GmbH. This is available in three metre lengths. One preferred embodiment (shown in FIG. 21) has a lower coilable resilient support 307 of about 147 cm and an upper coilable resilient support 306 of about 76 cm, the supports 306, 307 being spaced at their free ends by a distance of approximately 36 cm. In this way, it is possible to cut two lower supports 307 or one lower support and two upper supports 306 from a single length of material. As shown in FIG. 21, the fabric of the wall members 301, 302, 303, 304 is pulled taut in the sense of being pulled flat. Doors 312 and windows 313 may be included in the design in any arrangement.

FIG. 21 shows a collapsible fabric structure having the frame arrangement shown in FIG. 20.

Figure 22:
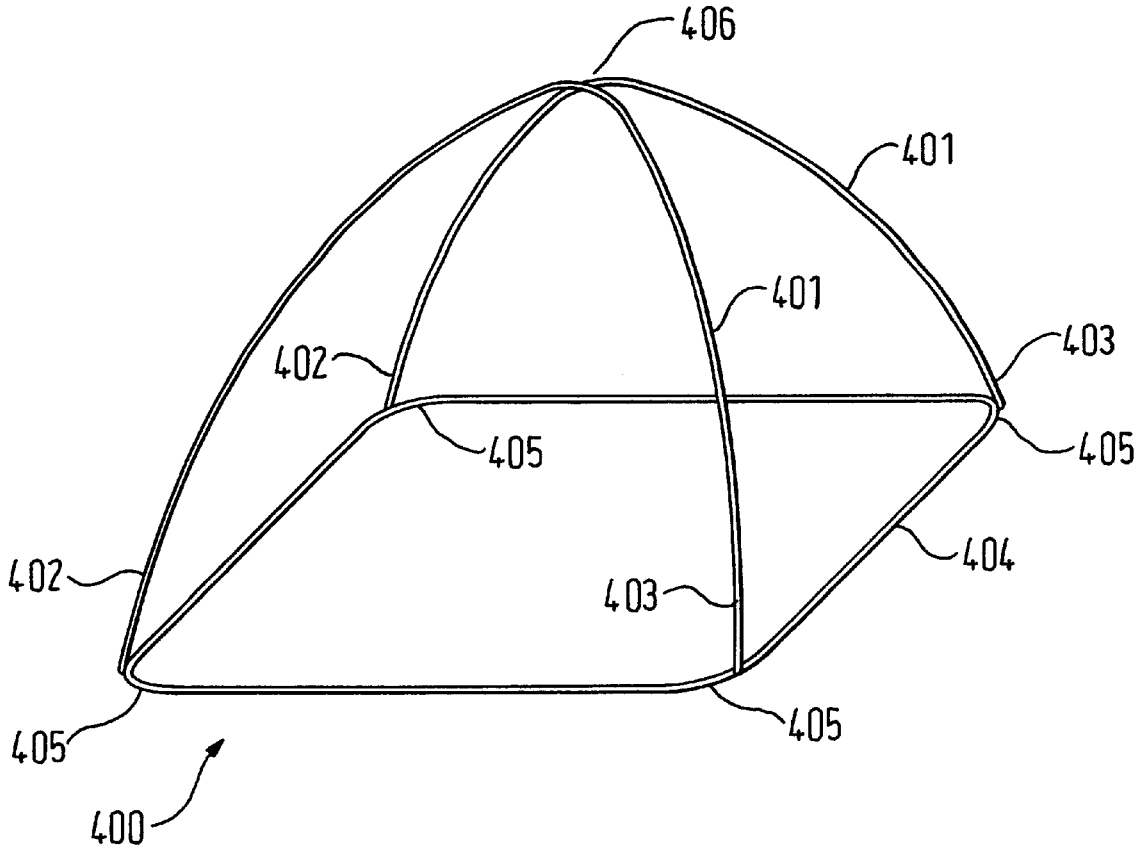
FIG. 22 shows a further embodiment for the frame structure of a pyramid style tent.

In FIG. 22, a collapsible fabric structure 400 having a different frame arrangement is shown. The structure has two resilient coilable frame members 401 that form an arch, each arch having a pair of free ends 402, 403. The arch forming members 401 each support the fabric (not shown) of a side panel, with the resiliency of the arch forming member generating tension in the fabric. The free ends 402, 403 of each arch forming member are held in a spaced relationship by a coilable frame member in the form of a loop 404 positioned in the base panel of the structure 400. The loop frame member 404 is preferably of spring steel strip and the arch forming members 401 are preferably of the composite rod material discussed above. In the embodiment shown, the free ends 402, 403 of the arch forming members 401 are positioned at the corners 405 of the loop frame member. The top portions of the arch forming members 401 preferably touch or are held in close proximity. For example, this may be achieved by means of stitching together frame confining pockets or the like. In the embodiment shown, the arches are rounded and form an apex 406 at the top of the structure. A ridge could be formed if so desired by confining the top portions of the arch forming members into a straight section by means of a frame confining pocket. Tension in the fabric developed through the cut of the material preferably urges the arch forming members 401 and their corresponding side panel into a curve to create an "igloo" shape.

The structure benefits from being almost entirely self-erectable: the user simply removes the structure from a storage bag or other containment means and allows the structure to self expand. In some instances it may be also necessary to give the structure a shake, either to encourage the frame members to spring out of their coiled up configuration or to shake out any panel which has not fully expanded due to, say, twisting of the frame member. To collapse the structure, a similar operation to the goal of FIG. 19 is followed. An arch forming member 401 is folded against the base panel and the base panel including the loop frame member 404 is coiled into three loops of smaller radius. As the panel containing the loop 404 is coiled, the arch forming members 401 automatically coil up to the same radius.

What is claimed is:

1. A collapsible fabric structure, comprising first and second wall members each having a coilable frame which forms a loop defining a pair of opposed sides when the structure is expanded and which is capable of being coiled into three loops when the structure is collapsed, a side of the first wall member being connected to a side of the second wall member, wherein the connection between the sides of the wall members is made by an elongate arch forming member of resilient material having a pair of free ends, the arch forming member being capable of being coiled when the structure is collapsed and, when the structure is expanded, forming an arch which extends from a first free end along at least part of the side of the first wall member, across to the side of the second wall member, and along at least part of the side of the second wall member to the second free end, the arch forming member exerting a separating force between the first and second wall members.

2. A structure as claimed in claim 1, wherein the arch forming member is capable of flexing at least in two orthogonal directions.

3. A structure as claimed in claim 2, wherein the arch forming member is of a fibre composite material.

4. A structure as claimed in claim 3, wherein the arch forming member is a glass fibre reinforced epoxy rod.

5. A structure as claimed in claim 3, wherein at the surface of the arch forming member, the fibre is wound helically.

6. A structure as claimed in claim 5, wherein the arch forming member is a rod having a diameter in the range of about 2 mm to 5 mm.

7. A structure as claimed in claim 1, wherein the arch forming member defines a wall of the structure.

8. A structure as claimed in claim 7, wherein fabric extends across the wall defined by the arch forming member.

9. A structure as claimed in claim 1, wherein the structure further includes a second arch forming member having a first free end and a second free end which also provides a separating force between the first and second wall members.

10. A structure as claimed in claim 9, wherein the first and second arch forming members both extend from the first wall member to the second wall member along a periphery of the structure.

11. A structure as claimed in claim 9, wherein the structure is in the form of a pyramid having an apex.

12. A structure as claimed in claim 9, wherein the structure is in the form of a truncated pyramid.

13. A structure as claimed in claim 9, wherein the structure has substantially upright walls.

14. A structure as claimed in claim 13, wherein the structure has a flat top.

15. A structure as claimed in claim 13, wherein the structure has a ridge.

16. A structure as claimed in claim 9, wherein the first and second arch forming members are arranged the same way up.

17. A structure as claimed in claim 16, wherein the first and second free ends of the first arch forming member extend in an opposed direction to the first and second free ends of the second arch forming member.

* * * * *